US009435306B2

(12) United States Patent
Aoki

(10) Patent No.: US 9,435,306 B2
(45) Date of Patent: Sep. 6, 2016

(54) FUEL SUPPLY PUMP

(71) Applicant: Robert Bosch GmbH, Stuttgart (DE)

(72) Inventor: Kenji Aoki, Saitama (JP)

(73) Assignee: Robert Bosch GmbH, Stuttgart (DE)

( * ) Notice: Subject to any disclaimer, the term of this patent is extended or adjusted under 35 U.S.C. 154(b) by 249 days.

(21) Appl. No.: 14/367,979

(22) PCT Filed: Nov. 12, 2012

(86) PCT No.: PCT/JP2012/079259

§ 371 (c)(1),
(2) Date: Jun. 23, 2014

(87) PCT Pub. No.: WO2013/094341

PCT Pub. Date: Jun. 27, 2013

(65) Prior Publication Data

US 2015/0037182 A1 Feb. 5, 2015

(30) Foreign Application Priority Data

Dec. 21, 2011 (JP) ..... 2011-279796

(51) Int. Cl.
*F02M 59/10* (2006.01)

(52) U.S. Cl.
CPC ..... *F02M 59/102* (2013.01); *F02M 2200/02* (2013.01)

(58) Field of Classification Search
CPC ..... F02M 59/102
USPC ..... 92/129
See application file for complete search history.

(56) References Cited

U.S. PATENT DOCUMENTS 5,415,533 A * 5/1995 Egger ..... F02M 39/00 123/90.5

FOREIGN PATENT DOCUMENTS

| | | | | |
|---|---|---|---|---|
| DE | 102004002487 | A1 | 8/2005 | |
| DE | 102008015547 | A1 | 10/2009 | |
| DE | 102008001890 | | 11/2009 | |
| DE | 102008001890 | A1 * | 11/2009 | ..... F02M 59/06 |
| JP | 5195907 | | 8/1993 | |
| JP | 6159192 | | 6/1994 | |
| JP | 2004163816 | A | 6/2004 | |
| JP | 2004204761 | | 7/2004 | |
| JP | 2006233922 | | 9/2006 | |

OTHER PUBLICATIONS

International Search Report for Application No. PCT/JP2012/079259 dated Dec. 25, 2012 (English Translation, 2 pages).

* cited by examiner

*Primary Examiner* — Thomas E Lazo
(74) *Attorney, Agent, or Firm* — Michael Best & Friedrich LLP

(57) ABSTRACT

A fuel supply pump in which even when a tappet slides at high speed, a sliding balance of the tappet is maintained and improved durability is achieved by preventing one-sided contact between the tappet and a cylinder hole.
The tappet is configured to have a cylindrical tappet body and a roller, and a cylindrical guide ring is fixed into the cylinder hole. In the tappet body and a cylindrical portion of the guide ring, a tappet side guide portion and a guide ring side guide portion which can be fitted thereto in an axial direction are provided in at least two locations at equal intervals.

9 Claims, 9 Drawing Sheets

FUEL SUPPLY PUMP

BACKGROUND OF THE INVENTION

The present invention relates to a fuel supply pump for use in an internal combustion engine including a tappet guide structure for preventing a pivotal movement of a tappet.

As a tappet guide structure for preventing a pivotal movement of a tappet of a fuel supply pump used in an internal combustion engine such as a diesel engine, a configuration disclosed in JP-A-5-195907 or JP-A-2004-204761 has been known.

JP-A-5-195907 discloses that in order to prevent the circumferential pivotal movement of the tappet which reciprocates in a cylinder hole formed inside a pump housing of the fuel supply pump in an axial direction, a positioning tappet guide groove which is parallel to the axial direction is disposed on an inner peripheral surface of the cylinder hole, a slider protruding in a direction perpendicular to an axis of the cylinder hole is formed in the tappet, and the protruding slider is configured to reciprocate in the tappet guide groove, thereby preventing the pivotal movement of the tappet.

As a configuration for preventing the circumferential pivotal movement of the tappet which reciprocates in the cylinder hole formed inside the pump housing of the fuel supply pump in the axial direction, JP-A-2004-163816 discloses a configuration for preventing the pivotal movement of the tappet by disposing a slit-shaped through-hole on a side wall of the tappet, causing a guide pin to pass through the through-hole from outside of the pump housing, and using a tip portion of the guide pin to guide the slit-shaped through-hole of the tappet.

SUMMARY OF INVENTION

However, the tappet guide structure of the fuel supply pump disclosed in JP-A-5-195905 or JP-A-2004-163816 is one side guide structure where the slider which is one side of the tappet or the slit-shaped through-hole comes into sliding contact with the guide groove or the guide pin. Therefore, sliding resistance when the tappet slides varies between one side having the tappet guide structure and the other side having no tappet structure, thereby leading to an imbalance in a sliding balance of the tappet. The imbalance in the sliding balance of the tappet due to the one side guide structure is responsible for wear of a guide portion. Furthermore, in recently used fuel supply pumps, pump rotations have progressively become faster, and therefore a sliding speed of the tappet becomes faster. Consequently, when the imbalance in the sliding balance even slightly causes one-sided contact between the tappet and the cylinder hole, the wear is not confined to the contact place therebetween, and there is a possibility of immediately causing a sliding failure such as a seizure of the tappet.

Therefore, as a result of intensive studies, the present inventor has contrived a solution to this problem by providing the cylinder hole with a guide ring as the guide structure for preventing the pivotal movement of the tappet, thereby completing the present invention. That is, the present invention aims to provide a fuel supply pump in which even when the tappet slides at high speed, the sliding balance of the tappet is maintained and improved durability is achieved by preventing the one-sided contact between the tappet and the cylinder hole.

According to an aspect of the invention, the above-described problem can be solved by providing a fuel supply pump including a pump housing, a cylinder head that is fitted to a cylinder hole formed in the pump housing, a plunger that is slidably fitted to a sliding hole formed in the cylinder head, a tappet that is slidably fitted to the cylinder hole, a cam shaft that is rotatably supported in a cam chamber formed inside the pump housing so as to communicate with the cylinder hole, a cam that is formed integrally with the cam shaft, and a plunger spring that is interposed between the cylinder head and the tappet. The tappet is configured to have a cylindrical tappet body and a roller, and a cylindrical guide ring is fixed into the cylinder hole. In the tappet body and a cylindrical portion of the guide ring, a tappet side guide portion and a guide ring side guide portion which can be fitted thereto in an axial direction are provided in at least two locations at equal intervals.

In addition, when configuring the fuel supply pump of the present invention, it is preferable to provide pivotal movement preventing means of the guide ring which is configured between the guide ring and the pump housing or between the guide ring and the cylinder head, or alternatively between the guide ring, the pump housing, and the cylinder head.

In addition, when configuring the fuel supply pump of the present invention, it is preferable that the guide ring include a seat flange portion which seats the plunger spring, and the seat flange portion be interposed between the plunger spring and the cylinder head.

In addition, when configuring the fuel supply pump of the present invention, it is preferable that the guide ring be molded integrally with the cylinder head.

In addition, when configuring the fuel supply pump of the present invention, it is preferable that a shape of the tappet side guide portion be a tapered shape.

In addition, when configuring the fuel supply pump of the present invention, it is preferable that the guide ring side guide portion be formed in a concave shape, and the tappet side guide portion be formed in a convex shape.

According to the fuel supply pump of the present invention, the guide structure for preventing the pivotal movement with respect to the axial direction of the tappet employs the structure where in the respective cylindrical portions of the cylindrical tappet body of the tappet and the cylindrical guide ring fixed into the cylinder hole, the tappet side guide portion and the guide ring side guide portion which can be fitted thereto in the axial direction are provided in at least two locations at equal intervals. Therefore, the sliding resistance when the tappet reciprocates in the cylinder hole is equally maintained. Accordingly, since the imbalance in the sliding balance is improved, the uneven contact with the cylinder hole is suppressed when the tappet slides. As a result, even when the fuel supply pump is operated at a high speed, the tappet can stably reciprocate. Thus, it is possible to prevent the sliding failure.

In addition, in the fuel supply pump of the present invention, there is provided the pivotal movement preventing means of the guide ring which is configured between the guide ring and the pump housing, or between the guide ring and the cylinder head, or alternatively, between the guide ring, the pump housing, and the cylinder head. In this manner, when the fuel supply pump is assembled, it is possible to prevent the guide ring from being assembled in an incorrect direction. In addition, when the fuel supply pump is driven, it is possible to prevent the guide ring from being pivotally moved together with the tappet.

In addition, in the fuel supply pump of the present invention, the guide ring includes the seat flange portion, and the seat flange portion is interposed between the plunger spring and the cylinder head. In this manner, it is no longer necessary to press-insert the guide ring into the cylinder hole or to fix the guide ring using a pin or the like. Therefore, it is possible to facilitate attachment and detachment of the guide ring to and from the cylinder hole.

In addition, in the fuel supply pump of the present invention, the guide ring is configured to be molded integrally with the cylinder head. In this manner, it is not necessary to separately dispose the guide ring. Since the pivotal movement preventing means of the guide ring is not also required, it is possible to configure the tappet guide structure which is an object of the present application without increasing the number of components.

In addition, in the fuel supply pump of the present invention, the shape of the tappet side guide portion is configured to be the tapered shape. In this manner, the tappet side guide portion and the guide ring side guide portion do not unnecessarily come into contact with each other. Therefore, even when the fuel supply pump is operated at a high speed, without interfering with the sliding of the tappet, it is also possible to reduce the wear of the tappet side guide portion and the guide ring side guide portion.

In addition, in the fuel supply pump of the present invention, the guide ring side guide portion is configured to have the concave shape, and the tappet side guide portion is configured to have the convex shape. In this manner, there is no possibility of weakening the strength of the tappet to which a load is likely to be applied. Accordingly, it is possible to ensure durability of the tappet.

DETAILED DESCRIPTION

Figure 1:
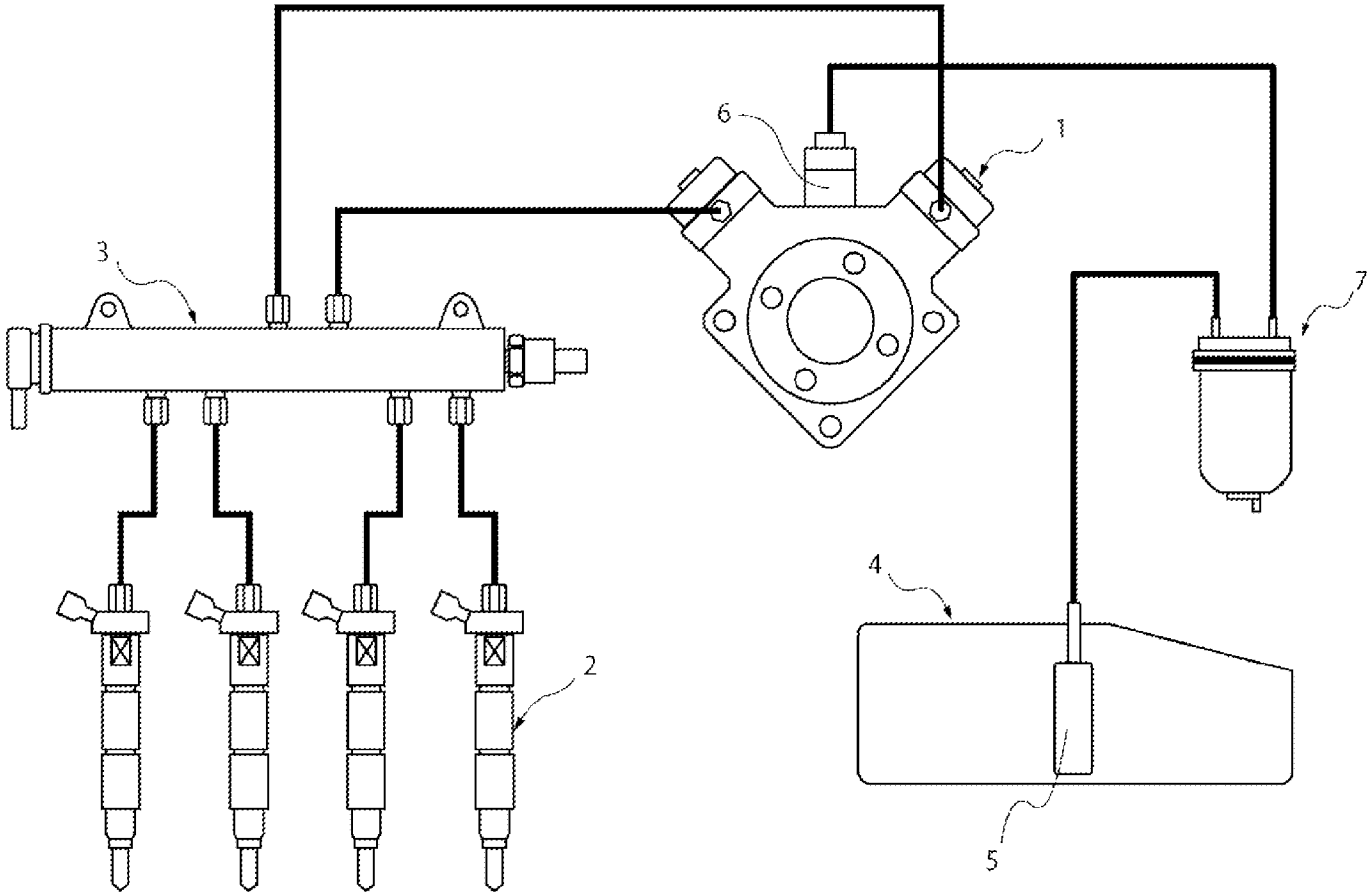
FIG. 1 is a schematic view of an accumulator fuel injection system using a fuel supply pump of the present invention.

Hereinafter, embodiments relating to a fuel supply pump of the present invention will be described in detail with reference to the drawings. However, the relevant embodiments show an aspect of the present invention. The embodiments are not construed as limiting the present invention, but can be arbitrarily changed within the scope of the present invention.

In the respective drawings, elements having the same reference numerals represent the same members, and description thereof is appropriately omitted.

FIG. 1 illustrates a schematic view of an accumulator fuel injection system using a fuel supply pump of the present invention. Respective configuring elements of the accumulator fuel injection system are connected by a fuel passage, and are controlled by a control device (not illustrated).

In the accumulator fuel injection system illustrated in FIG. 1, a fuel drawn by a low pressure feed pump 5 installed inside a fuel tank 4 is fed to a fuel supply pump 1 via a filter 7. The fuel is adjusted to have a required fuel flow rate by a flow rate control valve 6 inside the fuel supply pump 1, and then is supplied thereto. The surplus fuel here is returned to the fuel tank 4 through a return line (not illustrated). The fuel supplied to the fuel supply pump 1 is pressurized, and is press-fed to a common rail 3 as a high pressure fuel. Then, the high pressure fuel inside the common rail 3 is subjected to precise injection control by a control device (not illustrated), and is injected to an internal combustion engine through an injector 2 connected to the common rail 3.

The low pressure feed pump 5 of the above-described accumulator fuel injection system feeds the fuel which is regulated to have a pressure of approximately 5 bars by a regulator valve or the like (not illustrated), to the fuel supply pump 1. As the low pressure feed pump configured to be installed inside the fuel tank illustrated in FIG. 1, an electric pump which can be independently driven is used. However, in addition to the electric pump, the low pressure feed pump 5 can also employ a mechanical pump which is disposed integrally with the fuel supply pump and driven by a driving shaft of the fuel supply pump. For example, it is possible to employ a configuration which has a gear pump structure including a driving gear connected to an end portion of the driving shaft of the fuel supply pump and a driven gear connected to the driving gear, and in which the fuel is fed to the fuel supply pump by sucking up the fuel inside the fuel tank using a negative pressure generated by driving the gear pump.

In addition, when foreign substances are mixed into the fuel inside the fuel tank 4, the filter 7 interposed between the low pressure feed pump 5 and its downstream side flow rate control valve 6 collects the foreign substances so that the foreign substances together with the fuel do not flow into the fuel supply pump 1, thereby preventing malfunction such as breakage caused by the foreign substances in the fuel supply pump.

In addition, for example, the flow rate control valve 6 is configured to use an electromagnetic proportional control valve. The flow rate control valve 6 adjusts an energization amount in accordance with operation conditions of the internal combustion engine or the required common rail pressure, thereby adjusting a supply amount of the fuel pressurized by the fuel supply pump 1.

In addition, for example, the common rail 3 can pressure-accumulate the high pressure fuel of 2,000 bars or more, and the pressure of the pressure-accumulated fuel is controlled by an amount of the fuel press-fed from the fuel supply pump 1. The control of the fuel pressure can also be configured by disposing a pressure controlling electromagnetic valve in the common rail 3.

In addition, the injector 2 is configured to have a nozzle portion ejecting the high pressure fuel by using the opening and closing of a needle valve and a holder portion including a solenoid valve for controlling a back pressure of the needle valve. The high pressure fuel is supplied from the common rail 3 to a back pressure chamber disposed in the holder portion, as the back pressure of the needle valve. The communication between the back pressure chamber and a fuel return passage (not illustrated) is blocked by the solenoid valve. In this manner, a delicate injection amount control can be performed by controlling the back pressure applied to the needle valve and by opening and closing the needle valve.

Figure 2:
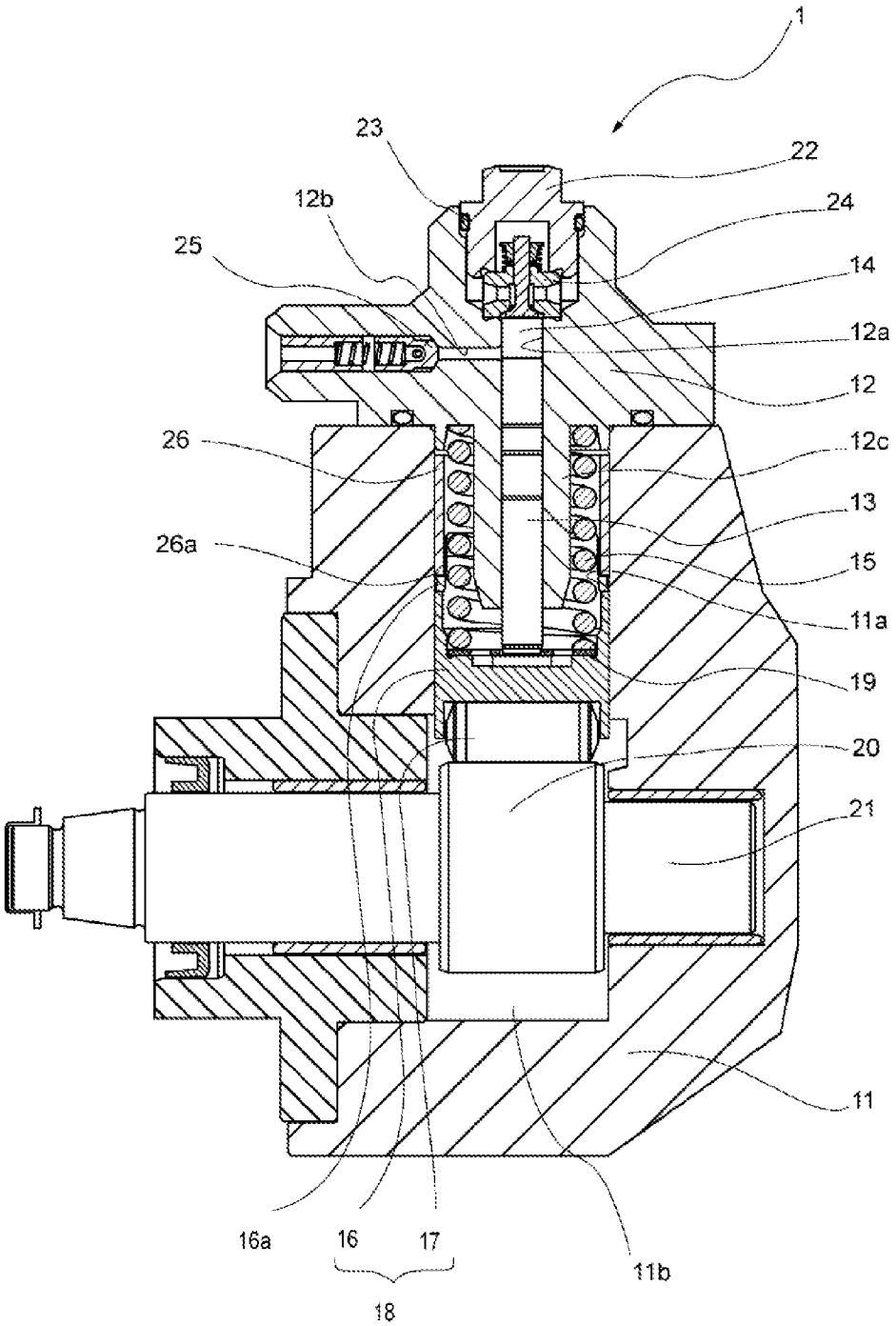
FIG. 2 is a cross-sectional view for illustrating a fuel supply pump of the present invention.

FIG. 2 illustrates a cross-sectional view in which the fuel supply pump 1 of the present invention is cut off along the axial direction of a plunger 13. The fuel supply pump 1 includes a pump housing 11 having a cam chamber 11*b* in which a cam 20 is rotatably accommodated and a cylinder hole 11*a* disposed so as to communicate with the cam chamber 11*b*, and a cylinder head 12 mounted on the cylinder hole 11*a*. The plunger 13 is slidably held in a sliding hole 12*a* disposed inside a plunger barrel portion 12*c* extending to the cam chamber 11*b* side coaxially with the cylinder hole 11*a* from a surface of the pump housing 11 side of the cylinder head 12. A plunger spring seat 19 is locked by an end portion of the cam 20 side of the plunger 13. In addition, a plunger spring 15, both ends of which are interposed between the plunger spring seat 19 and the cylinder head 12, is arranged in the cylinder hole 11*a*. In this manner, the plunger 13 locked by the plunger spring seat 19 is biased against a downward side where the cam 20 is located.

In addition, a tappet 18 is interposed between the plunger 13 and the cam 20. In response to the rotation of the cam 20, the tappet 18 pushes the plunger 13 upward against a biasing force of the plunger spring 15. The tappet 18 included in the fuel supply pump 1 of the present invention is configured to have a roller 17 and a tappet body 16. The tappet body 16 includes a roller holding portion which holds the roller 17 to be slidable and a cylindrical portion which slides with an inner peripheral surface of the cylinder hole 11*a*.

The tappet is not limited thereto. For example, a tappet may be used which has a structure in which a roller is provided with a shaft portion and a roller holding portion which holds the roller shaft without coming into peripheral contact with the roller.

A tappet side guide portion 16*a* is disposed in a cylindrical portion of the tappet body 16, and a guide ring side guide portion 26*a* is disposed in a cylindrical portion of a guide ring 26 fixed to the cylinder hole 11*a*. The tappet guide structure according to Embodiment 1 is formed by the tappet side guide portion 16*a* and the guide ring side guide portion 26*a*. The tappet guide structure will be described in detail later.

A fuel supply passage (not illustrated) is disposed in the cylinder head 12 and the pump housing 11, and the fuel is supplied to a fuel inlet valve 24 arranged inside the cylinder head 12. The fuel inlet valve 24 is pressed and fixed by a screw plug 22 so as to close the sliding hole 12*a* inside the cylinder head 12. A screw groove is formed on an outer peripheral surface of the screw plug 22 and on an inner peripheral surface of a space where the fuel inlet valve 24 of the cylinder head 12 is arranged. The screw plug 22 is in thread engagement with the cylinder head 12 so as to interpose a fuel seal ring 23 therebetween.

In addition, the fuel inlet valve 24 is placed so as to close the sliding hole 12*a*, a fuel outlet valve 26 is arranged in a fuel outlet passage 12*b* formed above the inner peripheral surface of the sliding hole 12*a*, and the plunger 13 partitions the sliding hole 12*a*, thereby forming a pressure chamber 14. Then, the fuel inlet valve 24 is opened when the negative pressure is generated inside the pressure chamber 14 during a descending process of the plunger 13, and the low pressure fuel fed by the low pressure feed pump 5 is supplied to the pressure chamber 14. In contrast, during an ascending process of the plunger 13, the fuel inlet valve 24 is closed to increase the pressure of the fuel inside the pressure chamber 14 and the fuel outlet valve 25 is opened. In this manner, the highly pressurized fuel is press-fed to the common rail 3 on the downstream side.

An overall configuration of the fuel supply pump of the present invention has been described using an example in FIG. 2. However, the fuel supply pump is not limited thereto. For example, the fuel supply pump may have a configuration where a reciprocal movement of a plunger can be performed by using the revolution of a cam ring. Furthermore, the fuel supply pump may have a configuration where multiple pressure chambers are arrayed in the axial direction of a cam shaft.

FIGS. 3 to 7 illustrate embodiments of the tappet guide structure which are embodied for the fuel supply pump of the present invention. Hereinafter, Embodiments 1 to 5 will be respectively described.

Tappet Guide Structure in Embodiment 1 (1)

Figure 3:
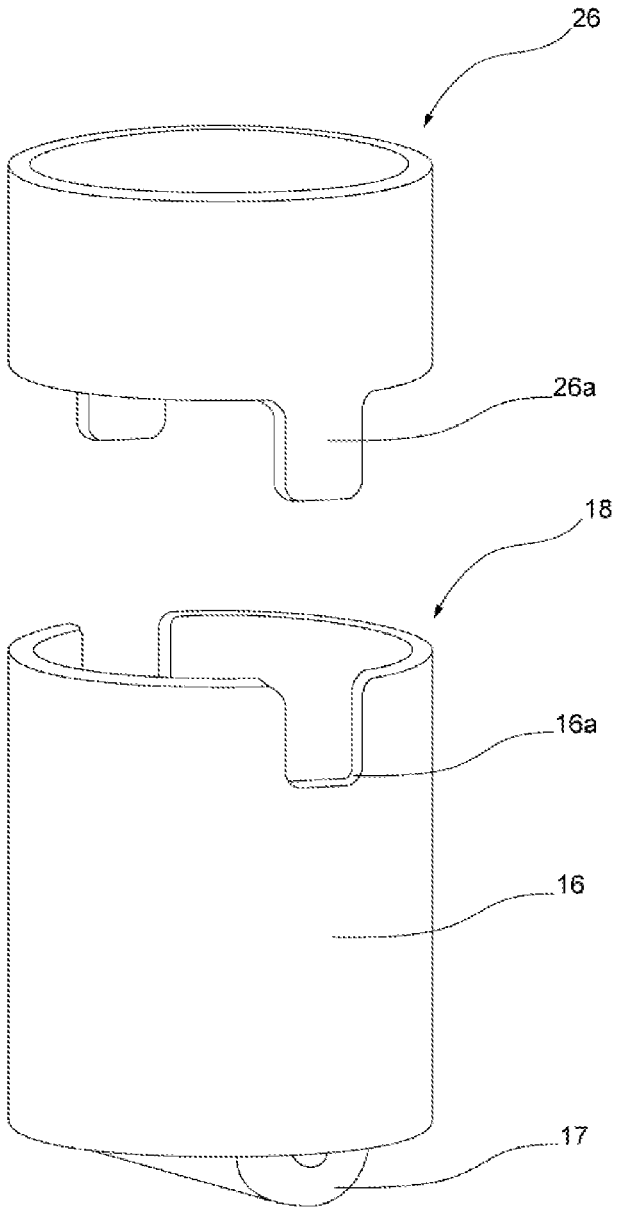
FIG. 3 is a perspective view for illustrating a guide structure of Embodiment 1.

FIG. 3 is a perspective view of the tappet 18 and the guide ring 26 which are main portions of the fuel supply pump in FIG. 2, and illustrates a tappet guide structure according to Embodiment 1. The tappet guide structure according to Embodiment 1 will be described with reference to FIG. 2.

The guide ring 26 has an outer diameter which is substantially the same as that of the cylinder hole 11*a* of the pump housing 11, and is fixed to the cylinder hole 11*a* by press-insertion. In the cylindrical portion of the guide ring 26, the guide ring side guide portion 26*a* having a shape vertically protruding downward from the cylinder hole 11*a* is disposed in two locations at equal intervals in a circumferential direction. In addition, even in the tappet 18, in the cylindrical portion of the tappet body 16, the tappet side guide portion 16*a* having a vertically cut-out shape is disposed at two locations so as to be axially fitted to the guide ring side guide portion 26*a* in two locations of the guide ring 26.

A depth of the cut-out portion of the tappet side guide portion 16*a* and a length of the protruding portion of the guide ring side guide portion 26*a* are configured to be longer than a pumping stroke of the fuel supply pump 1. Therefore, by appropriately adjusting a fixing position of the guide ring 26 to the cylinder hole 11*a*, the tappet side guide portion 16*a* is always guided by the guide ring side guide portion 26*a* while the tappet 18 moves from bottom dead center to top dead center.

Accordingly, in the tappet guide structure according to Embodiment 1 where the tappet side guide portion 26*a* and the guide ring side guide portion 16*a* are disposed in at least two locations at equal intervals on the circumference of the cylindrical surface of the guide ring 26 and the tappet 18, a weight balance of the tappet is better than that of a structure where the tappet is guided in only one side, and sliding resistance is more equally maintained when the tappet reciprocates in the cylinder hole. Therefore, the imbalance in the sliding balance is improved. This suppresses the uneven contact with the cylinder hole when the tappet slides. Accordingly, even when the fuel supply pump is operated at a high speed, the tappet can stably reciprocate. Thus, it is possible to prevent the sliding failure.

In addition, it is not necessary to axially dispose the tappet guide groove on the inner peripheral surface of the cylinder hole 11*a* inside the pump housing 11. Therefore, it is possible to simply form the guide structure. Accordingly, it is not necessary to provide an expensive dedicated processing device for forming the tappet guide groove. Therefore, it is possible to save on the manufacturing cost for the overall fuel supply pump.

In addition, in the tappet guide structure according to Embodiment 1, there is no guide pin passing through the pump housing, and there is no need to dispose a through-hole in the pump housing. Therefore, there is no possibility that a lubricant may leak out to the outside of the pump from the through-hole.

In the configuration according to Embodiment 1 where the guide ring 26 is press-inserted into the cylinder hole 11*a*, a material of the guide ring 26 is the same as a material of the pump housing 11. Therefore, when the fuel supply pump 1 is driven, even if a temperature change occurs in the pump housing 11, the guide ring 26 fixedly press-inserted into the cylinder hole 11*a* of the pump housing 11 is expanded and contracted similar to the pump housing 11, and thus can maintain a fastening force. Accordingly, it is possible to prevent loosening or slipping-out of the press-inserted guide ring 26.

Tappet Guide Structure in Embodiment 2 (2)

Figure 4:
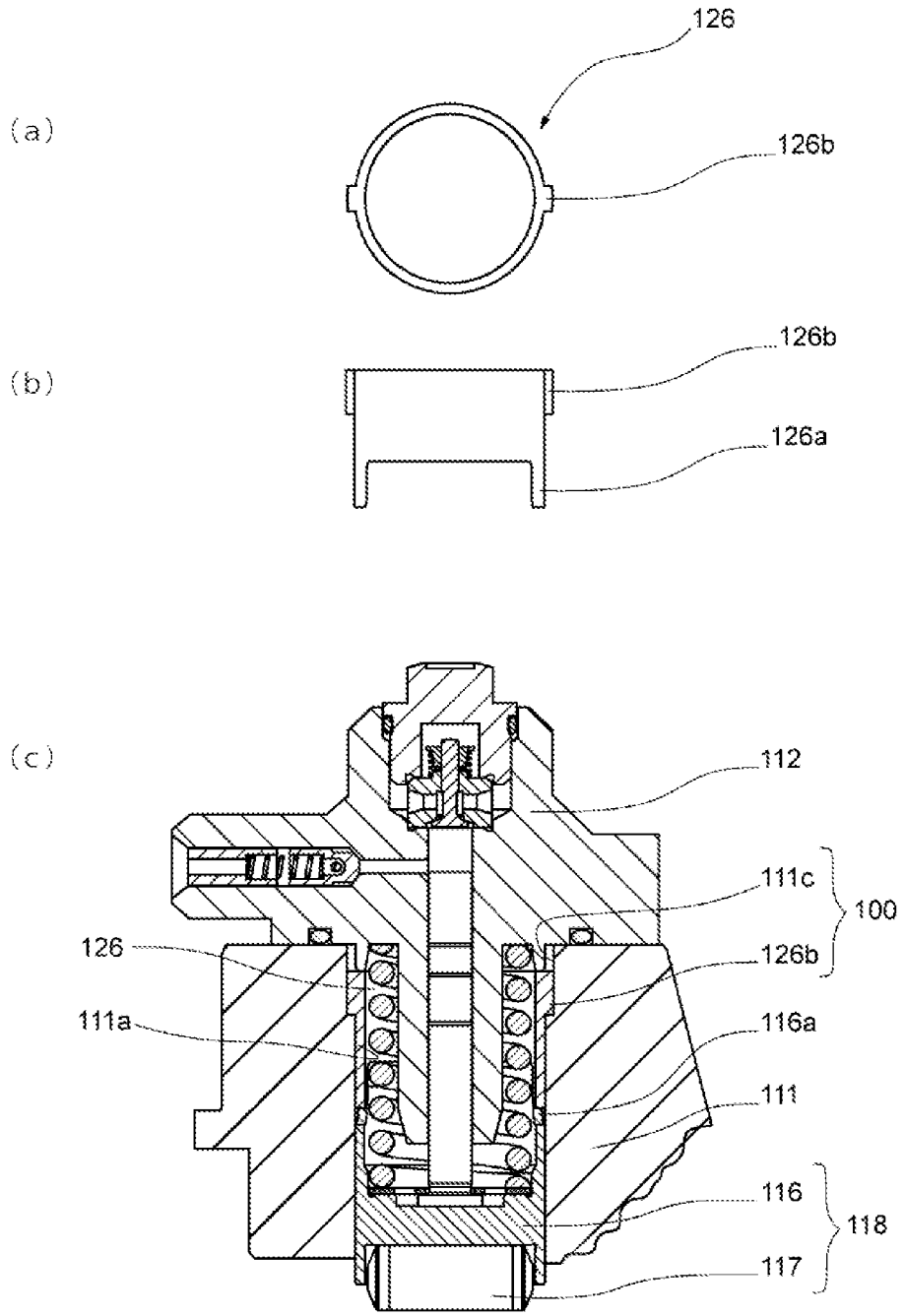
FIG. 4 is a plan view for illustrating a guide structure of Embodiment 2.

FIG. 4 illustrates pivotal movement preventing means 100 for preventing a circumferential pivotal movement of a guide ring 126 with respect to a cylinder hole 111*a*. FIGS. 4(*a*) and 4(*b*) illustrate plan views of an upper surface and a side surface of the guide ring 126, and FIG. 4(*c*) illustrates a cross-sectional view of a main portion of the fuel supply pump 1 to which the guide ring 126 is assembled.

The pivotal movement preventing means 100 is configured to include a protruding portion 126*b* which is disposed in two locations at equal intervals so as to protrude in the radial direction on the cylinder head 12 side of the cylindrical portion of the guide ring 126, and a groove portion 111*c* in two locations which is disposed so as to be fitted to the protruding portion 126*b* in an opening portion of the cylinder head 12 side of the cylinder hole 111*a*.

The protruding portion 126*b* of the guide ring 126 is disposed in the same phase with a guide ring side guide portion 126*a* in two locations which vertically protrudes downward from the cylindrical portion of the guide ring 126. In addition, the groove portion 111*b* in two locations of the cylinder hole 111*a* is disposed at a position parallel to a center line of the cam shaft 21 in the opening portion of the cylinder hole 111*a*. Therefore, when the fuel supply pump is assembled, the protruding portion 126*b* is fitted to the groove portion 111*c*. In this manner, it is possible to prevent the guide ring 126 from being assembled to the cylinder hole 111*a* in an incorrect direction. In addition, when the fuel supply pump is driven, it is possible to prevent the guide ring 126 from being pivotally moved together with a tappet 118.

In the pivotal movement preventing means 100 of the tappet guide structure according to Embodiment 2, the protruding portion 126*b* is configured to be locked by the groove portion 111*c*. Therefore, in the guide ring 126, a position in the axial direction of the cylinder hole is also fixed. Accordingly, when the guide ring 126 is assembled to the cylinder hole 111*a*, the guide ring 126 may not be fixedly press-inserted into the cylinder hole 111*a*. The guide ring 126 can be easily detached from the cylinder hole 111*a* during maintenance.

In the pivotal movement preventing means 100 according to Embodiment 2, the protruding portion 126*b* and the groove portion 111*c* are configured to be respectively disposed in two locations in the guide ring 126 and the cylinder hole 111*a*. However, if the pivotal movement preventing means 100 is configured to have the protruding portion 126*b* and the groove portion 111*c* in at least one location, it is possible to prevent the circumferential pivotal movement with respect to the cylinder hole of the guide ring 126.

In addition, the pivotal movement preventing means 100 is provided with the protruding portion 126*b* protruding in the radial direction of the guide ring 126. However, as the configuration where a notch or a groove is disposed in the cylindrical portion of the guide ring, a configuration may be employed where a key or a pin is fitted to the groove portion 111*c* of the cylinder hole 111*a*.

Tappet Guide Structure in Embodiment 3 (3)

Figure 5:
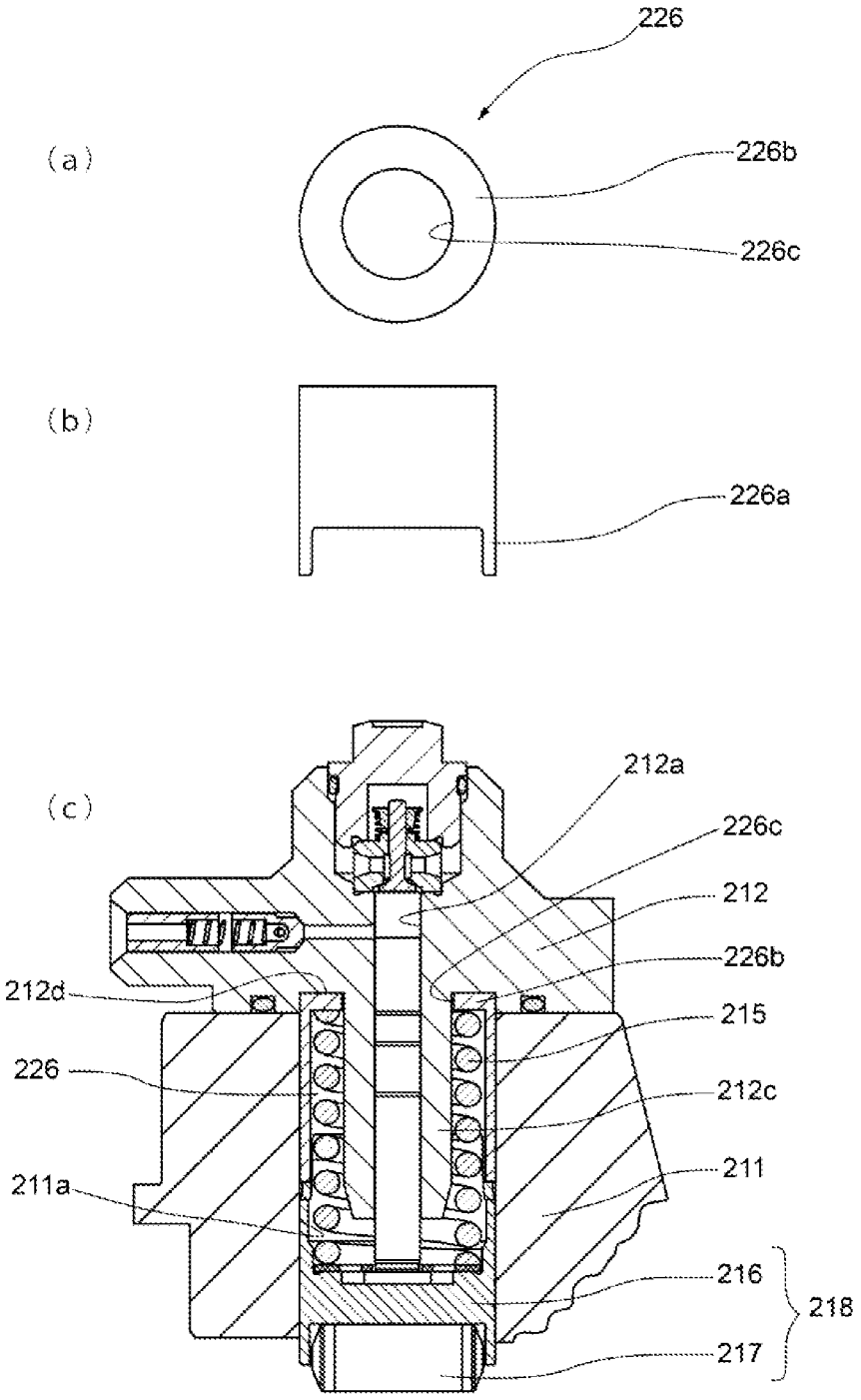
FIG. 5 is a plan view for illustrating a guide structure of Embodiment 3.

FIG. 5 illustrates a guide ring 226 which does not need to be fixedly press-inserted. FIGS. 5(*a*) and 5(*b*) illustrate plan views of the upper surface and the side surface of the guide ring 226, and FIG. 5(*c*) illustrates a cross-sectional view of a main portion of the fuel supply pump 1 to which the guide ring 226 is assembled.

A seat flange portion 226*b* which can seat a plunger spring 215 is disposed in an end portion of a cylinder head 212 of the guide ring 226. Then, an insertion hole 226*c* into which a plunger barrel portion 212*c* of the cylinder head 212 can be inserted is disposed in the seat flange portion 226*b*.

The guide ring 226 is arranged at an appropriate position of the cylinder hole based on a predetermined dimension and shape in such a manner that the seat flange portion 226*b* is interposed and assembled between the plunger spring 215 and the cylinder head 212. Accordingly, it is not necessary to fixedly press-insert the guide ring 226 into the cylinder hole. The guide ring 226 may be simply inserted into the cylinder hole 211*a*.

In addition, when the cylinder head 212 is assembled, the guide ring 226 inserted into the cylinder hole 211*a* also functions as a spigot joint (fitting alignment). The guide ring 226 is fitted to a guide ring accommodating recess 212*d* disposed on a joining surface between the cylinder head 212 and the pump housing 211. In this manner, it is possible to coaxially assemble a sliding hole 212*a* of the cylinder head 212 and the cylinder hole 211*a* of the pump housing 211.

In Embodiment 3, the guide ring 226 is configured to have the function of the spigot joint. However, as in the cylinder head 12 in Embodiment 1, the spigot joint may be configured to be disposed on the cylinder head side.

Tappet Guide Structure in Embodiment 4 (4)

Figure 6:
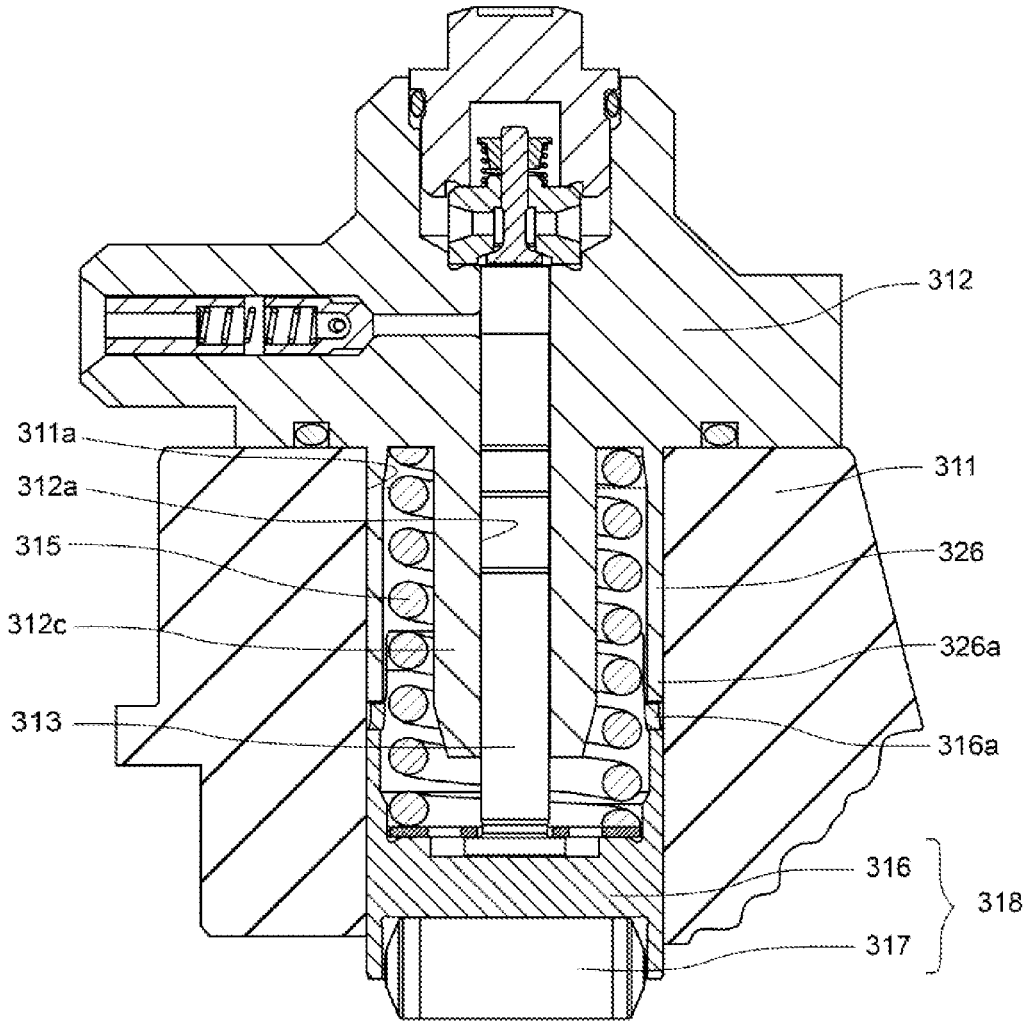
FIG. 6 is a plan view for illustrating a guide structure of Embodiment 4.

FIG. 6 illustrates a cylinder head 312 with which the guide ring is integrally disposed. A cylindrical guide ring portion 326 is disposed coaxially with a plunger barrel portion 312*c* in the cylinder head 312 so as to surround the plunger barrel portion 312*c*. In order to accommodate a plunger spring 315, an inner diameter of the guide ring portion 326 is larger than that of the plunger spring 315. Since the guide ring portion 326 serves as the spigot joint when the cylinder head 312 is assembled to a cylinder hole 311*a* of a pump housing 311, an outer diameter of the guide ring portion 326 is configured to be substantially the same as that of the cylinder hole 311*a*.

In the guide ring portion 326, a guide ring side guide portion 326*a* having a shape vertically protruding downward from the cylinder hole is disposed in two locations at equal intervals. Similar to the other embodiments, a tappet side guide portion 316*a* disposed in a tappet 318 is configured to be guided by the guide ring side guide portion 326*a*.

As a method of molding the guide ring portion 326 integrally with the cylinder head 312, it is preferable to perform integral molding by casting. However, the guide ring portion 326 and the cylinder head 312 can be integrated with each other by being individually molded and then being welded.

Tappet Guide Structure in Embodiment 5 (5)

Figure 7:
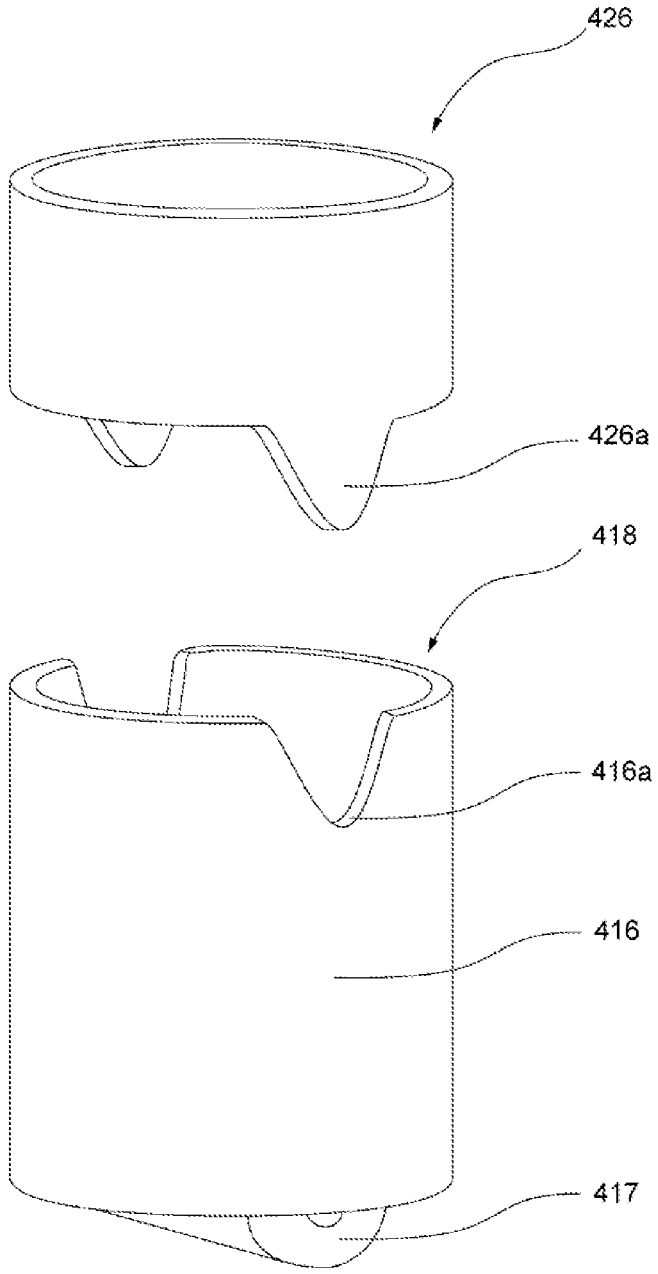
FIG. 7 is a perspective view for illustrating a guide structure of Embodiment 5.

FIG. 7 illustrates a tappet guide structure where a tappet side guide portion 416*a* and a guide ring side guide portion

426*a* do not unnecessarily come into contact with each other. Those which employ the tappet guide structure according to Embodiment 5 in the fuel supply pump in FIG. 2 will be described with reference to FIGS. 7 and 2.

According to the tappet guide structure in Embodiment 5, the tappet side guide portion 416*a* and the guide ring side guide portion 426*a* are configured to have a tapered shape. Therefore, particularly in an initial stage when a tappet 418 is lifted, the tappet side guide portion 416*a* does not come into contact with the guide ring side guide portion 426*a* unless the tappet 418 is in an abnormal pivotal movement. In other words, only when the tappet 418 abnormally performs the pivotal movement, the guide ring side guide portion 426*a* is configured to come into contact with and guide the tappet side guide portion 416*a*.

In a case of the tappet 418 having a roller 417, if the roller 417 is always in a rolling contact state between a tappet body 416 and the cam 20, a moment force acts on the roller 417 so as to maintain a linear contact state with a surface of the cam 20 in parallel with a center line of the cam shaft 21. For example, if this condition is continued, even when minute foreign substances are mixed into the lubricant or the like in the cam chamber 11*b* and the tappet 418 instantaneously performs the pivotal movement to some extent since the foreign substances are caught between the tappet body 416 and the roller 417, the above-described moment force enables the tappet 418 to correctly return to a normal position.

That is, the tappet guide structure needs to regulate the pivotal movement of the tappet 418 which is not corrected enough by the above-described moment force. However, a slight pivotal movement of the tappet 418 which can be corrected by the above-described moment force may be allowable.

Accordingly, the tappet guide does not need to regulate a small pivotal movement of the tappet 418 which is instantaneously performed. Therefore, by disposing the tappet side guide portion 416*a* having the tapered shape as in the tappet guide structure in Embodiment 5, the pivotal movement of the tappet 418 is allowed to some extent near the bottom dead center where the tappet 418 is likely to perform the pivotal movement. Therefore, the tappet side guide portion 416*a* and the guide ring side guide portion 426*a* do not unnecessarily come into contact with each other, and thus, the sliding of the tappet 418 is not inhibited. Furthermore, this also reduces the wear of the tappet side guide portion 416*a* and the guide ring side guide portion 426*a*.

In addition, according to the tappet guide structure having the tapered shape in Embodiment 5, the tappet 418 is reliably guided to the normal position near the top dead center where the tappet 418 ascends and the force acting on the tappet 418 becomes stronger. Therefore, the tappet 418 is not driven in the pivotal movement state, thereby also preventing abnormal wear between the roller 417 and the cam 21.

In a situation where the tappet side guide portion 416*a* is guided by the guide ring side guide portion 426*a*, the tapered shape of the guide ring side guide portion 426*a* is configured to have the same shape as the tapered shape of the tappet side guide portion 416*a*. In this manner, the guided portions are in surface contact with each other, thereby preventing the wear from being concentrated on one point.

The tapered shape of the tappet side guide portion 416*a* and the guide ring side guide portion 426*a* is appropriately designed and considered based on the maximum amount in the allowable range of the pivotal movement of the tappet 418.

As described above, according to the fuel supply pump of the present invention, the tappet guide structure is configured in view of the sliding balance of the tappet. Therefore, the uneven contact with the cylinder hole is suppressed when the tappet slides. Accordingly, even when the fuel supply pump is operated at a high speed, the tappet can stably reciprocate. Thus, it is possible to prevent the sliding failure.

The guide ring 26 of the tappet guide structure according to Embodiment 1 described above is fixed to the cylinder hole by press-insertion. However, the fixing method is not limited thereto. The fixing method can include various methods such as fixing by a screw or a pin and fixing by welding or an adhesive.

In addition, in the tappet guide structure according to Embodiment 2 described above, the pivotal movement preventing means 100 is configured to be disposed between the guide ring 126 and the pump housing 111. However, the pivotal movement preventing means 100 may be configured by using a positioning pin between the guide ring 126 and the cylinder head 112.

In addition, in all the embodiments, the configuration is made so that the convex guide ring side guide portion is disposed in the guide ring and the concave tappet side guide portion is disposed in the tappet. However, without being limited thereto, by reversing the concavity and convexity, a configuration may be made so that a concave guide ring side guide portion is disposed in the guide ring and a convex tappet side guide portion is disposed in the tappet.

Figure 8:
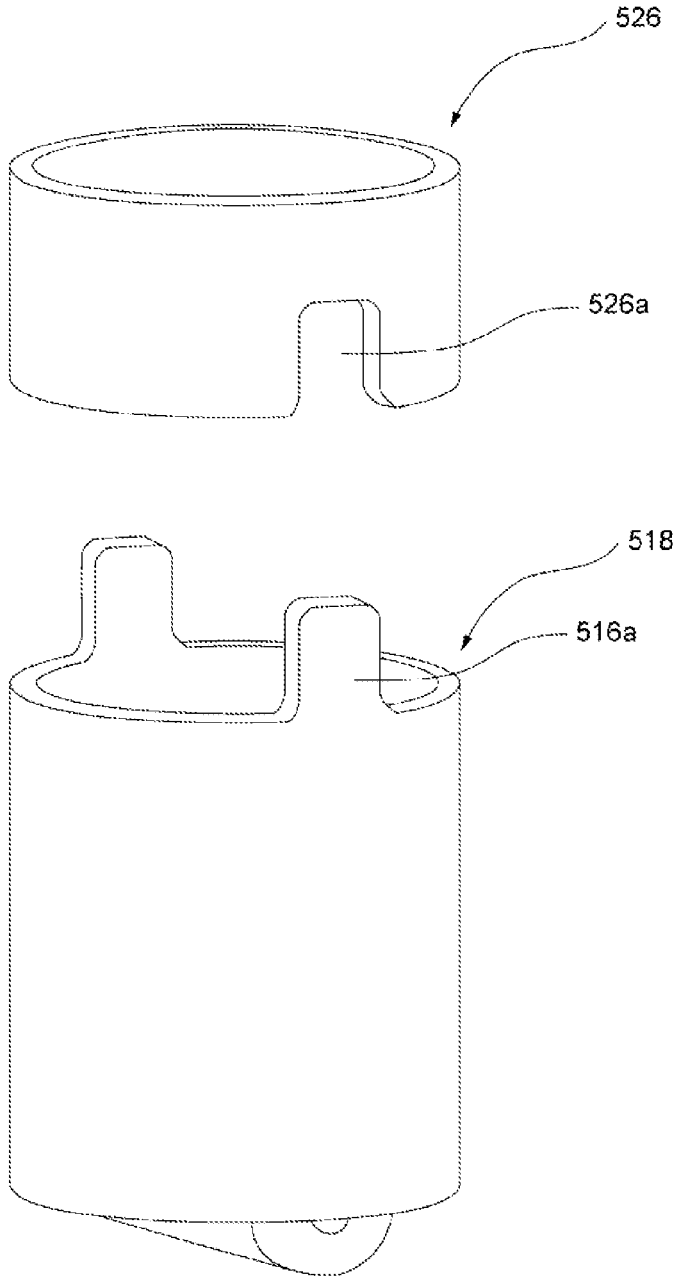
FIG. 8 is a perspective view for illustrating a modification example of the guide structure according to Embodiment 1.
Figure 9:
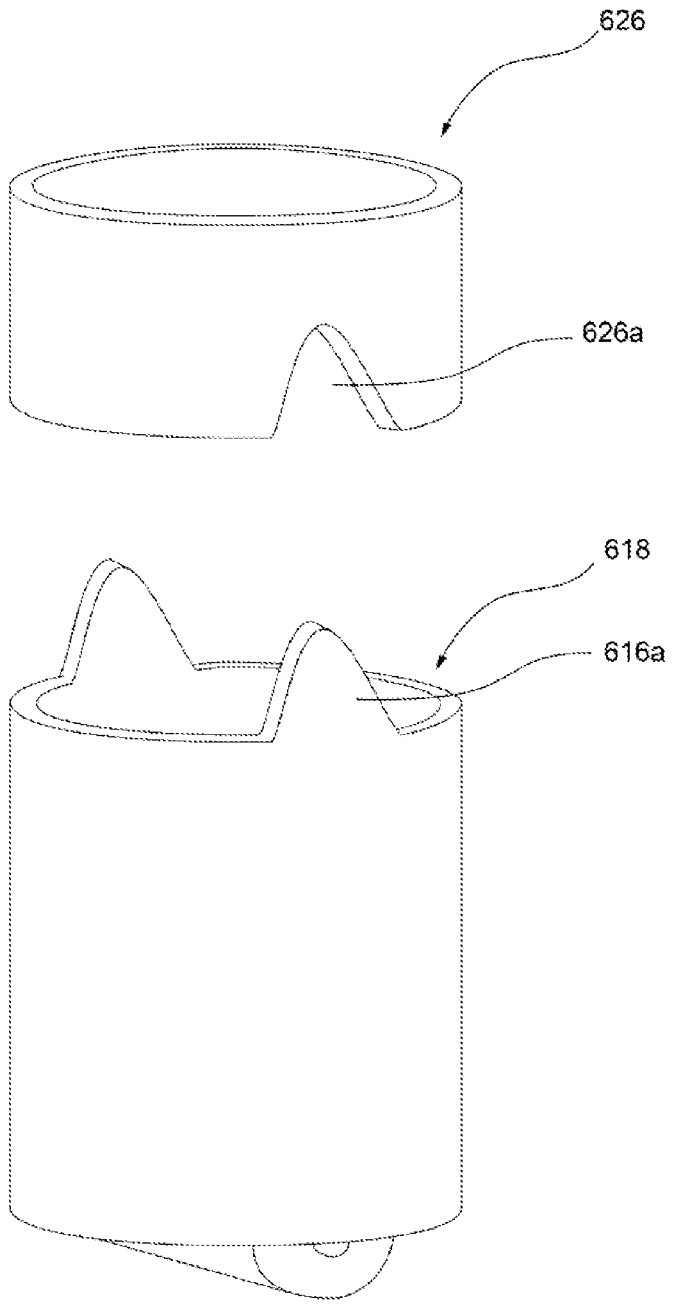
FIG. 9 is a perspective view for illustrating a modification example of the guide structure according to Embodiment 5.

For example, as illustrated in FIGS. 8 and 9, a configuration can also be made so that the concave guide ring side guide portions 526*a* and 626*a* are disposed in the guide rings 526 and 626 and the convex tappet side guide portions 518*a* and 618*a* are disposed in the tappets 518 and 618. In a case of this configuration, there is no possibility of weakening the strength of the tappets 518 and 618. Therefore, it is possible to ensure the durability of the tappets 518 and 618.

The invention claimed is:

1. A fuel supply pump comprising:

a pump housing;

a cylinder head that is fitted to a cylinder hole formed in the pump housing;

a plunger that is slidably fitted to a sliding hole formed in the cylinder head;

a tappet that is slidably fitted to the cylinder hole;

a cam shaft that is rotatably supported in a cam chamber formed inside the pump housing so as to communicate with the cylinder hole;

a cam that is formed integrally with the cam shaft; and a plunger spring that is interposed between the cylinder head and the tappet, wherein the tappet is configured to have a cylindrical tappet body and a roller, wherein a cylindrical guide ring is fixed into the cylinder hole, and wherein in the tappet body and a cylindrical portion of the guide ring, a tappet side guide portion and a guide ring side guide portion which can be fitted thereto in an axial direction are provided in at least two locations at equal intervals.

2. The fuel supply pump according to claim 1, further comprising means for preventing pivotal movement of the guide ring which is configured between the guide ring and at least one of the pump housing and the cylinder head.

3. The fuel supply pump according to claim 2,
wherein the guide ring includes a seat flange portion which seats the plunger spring, and the seat flange portion is interposed between the plunger spring and the cylinder head.

4. The fuel supply pump according to claim 1,
wherein the guide ring includes a seat flange portion which seats the plunger spring, and the seat flange portion is interposed between the plunger spring and the cylinder head.

5. The fuel supply pump according to claim 1,
wherein the guide ring is molded integrally with the cylinder head.

6. The fuel supply pump according to claim 5,
wherein a shape of the tappet side guide portion is a tapered shape.

7. The fuel supply pump according to claim 6,
wherein the guide ring side guide portion is formed in a concave shape and the tappet side guide portion is formed in a convex shape.

8. The fuel supply pump according to claim 1,
wherein a shape of the tappet side guide portion is a tapered shape.

9. The fuel supply pump according to claim 1,
wherein the guide ring side guide portion is formed in a concave shape and the tappet side guide portion is formed in a convex shape.

* * * * *